US005966691A

United States Patent [19]

Kibre et al.

[11] Patent Number: 5,966,691

[45] Date of Patent: Oct. 12, 1999

[54] MESSAGE ASSEMBLER USING PSEUDO RANDOMLY CHOSEN WORDS IN FINITE STATE SLOTS

[75] Inventors: Nicholas Kibre, Lompoc; Yoshizumi Terada, San Ramon; Kazue Hata; Rhonda Shaw, both of Santa Barbara, all of Calif.

[73] Assignee: Matsushita Electric Industrial Co., Ltd., Kadoma, Japan

[21] Appl. No.: 08/841,043

[22] Filed: Apr. 29, 1997

[51] Int. Cl.[6] ..... G10L 5/02

[52] U.S. Cl. ..... 704/260; 704/270

[58] Field of Search ..... 704/270, 275, 704/260

[56] References Cited

U.S. PATENT DOCUMENTS

| | | | |
|---|---|---|---|
| 4,595,980 | 6/1986 | Innes | 364/200 |
| 5,231,679 | 7/1993 | Goldhor et al. | 381/43 |
| 5,357,596 | 10/1994 | Takebayashi et al. | 395/2.84 |
| 5,377,303 | 12/1994 | Firman | 395/2.84 |
| 5,485,569 | 1/1996 | Goldman et al. | 395/159 |
| 5,498,003 | 3/1996 | Gechter | 273/434 |
| 5,566,248 | 10/1996 | Ulrich | 382/187 |
| 5,627,958 | 5/1997 | Potts et al. | 395/336 |

OTHER PUBLICATIONS

Ram–Shock Software Computer Training, Mar. 4, 1998, http://www.starlinx.net/ramshock/index.htm, pp. 1,2.

CineMac Screen Saver Factories, Mar. 6, 1998, http://www.macsourcery.com/web/html/body_cinemac.html, pp. 1,2.

Welcome to Petz, Mar. 6, 1998, http://www.petz.com/, p. 1.

Michael Bolton to the Rescue! Well, Maybe not . . . , Mar. 6, 1998, http://www.worldvillage.com/wv/cafe/html/reviews/screener.htm, pp. 1,2.

Kellog's Corn Pops, Mar 6, 1998, http://www.cornpops.com/, p. 1.

*Primary Examiner*—David R. Hudspeth
*Assistant Examiner*—Michael N. Opsasnick
*Attorney, Agent, or Firm*—Harness, Dickey & Pierce, P.L.C.

[57] ABSTRACT

The operating system or application program generates events captured by an event handler mechanism that, in turn, invokes message assembler and graphics assembler modules. The message assembler constructs pseudo-random sentences or notification messages based on the type of event captured and optionally upon selected state variables. The message assembler supplies text strings to a text-to-speech engine. A linguistic database containing a lexicon of predefined words supplies text data that the message assembler concatenates to form the text strings. Text strings are assembled and optionally tagged to alter the message, speaking voice and inflection based on the nature of the message and its context. Graphics elements are assembled by a graphics assembler in response to the event handler and based on optionally supplied user-defined graphics parameters.

14 Claims, 2 Drawing Sheets

MESSAGE ASSEMBLER USING PSEUDO RANDOMLY CHOSEN WORDS IN FINITE STATE SLOTS

BACKGROUND AND SUMMARY OF THE INVENTION

The present invention relates generally to multi-media computers and more particularly to a computerized personality system in the form of a screen saver or message notification system for making computers easier to interact with.

Originally the computer screen saver served the simple, but potentially important, function of blanking the computer screen after a certain period of inactivity. This was done to prevent a stationary image from being burned into the phosphor and permanently damaging the CRT. Subsequent screen saver applications have taken on an entertainment value, providing animated screen displays and playback of prerecorded audio clips and also a security function requiring entry of password prior to using computer. In general, the prerecorded sound clips have been hard coded into the screen saver application and have not been user definable. Also, there has been no mechanism for dynamically generating sound clips to fit differed events within the screen saver application. As such, the screen saver has remained largely a form of entertainment, with little other usefulness, aside from the original purpose of protecting CRT displays from image burn-in.

The present invention seeks to extend the screen saver into a new domain. Without diminishing-its usefulness in protecting CRT monitors and providing entertainment, the present system provides a computer personality and message notification system. The system automatically generates simulated spoken messages in response to events within the computer system. The user can easily customize these messages or add new messages simply by typing the message text into the system. A sophisticated text-to-speech engine with linguistic database generates naturally sounding speech that can accompany graphical displays such as computer generated animation. If desired, sophisticated rules may be employed in selecting and pronouncing the speech, simulating a human assistant.

According to one aspect of the invention, the system employs a linguistic database comprising a collection of words, names, phrases and/or grammatical elements. These entries may be tagged for their appropriateness to different contexts. A message assembler responsive to an event generation mechanism, assembles utterances (grammatical sentences, or at least natural sounding statements) from elements selected from the linguistic database. The event generation mechanism may be part of the computer operating system or incorporated into one or more application programs running on the operating system. An event handler mechanism determines the occurrence of certain events (in the simplest case, at random or regular intervals) or in response to monitored external events (such as user entered keystrokes, mouse clicks, operating system interupts, and so forth). The system further includes a text-to-speech engine that generates natural-sounding speech from the assembled utterances supplied by the message assembler.

To enhance the simulation of a human attendant, the message assembler may be sensitive to both the type of event relayed by the event generation mechanism and to optionally provided, user-defined parameters. This sensitivity may take the form of selecting different types of expressions or grammatical constructions under certain circumstances; or of using different subsets of the linguistic database under different circumstances.

The result is a simulated computer persona that can readily handle conventional screen saver functions, including security functions, while providing useful spoken messages that match the computer's operating context.

For a more complete understanding of the invention, its objects and advantages, reference may be had to the following specification and to the accompanying drawings.

FIG. 1 is a system block diagram of the Screen Saver and Message Notification System; and FIG. 2 is a flowchart diagram illustrating the system of the invention in operation.

DESCRIPTION OF THE PREFERRED EMBODIMENT

Figure 1:
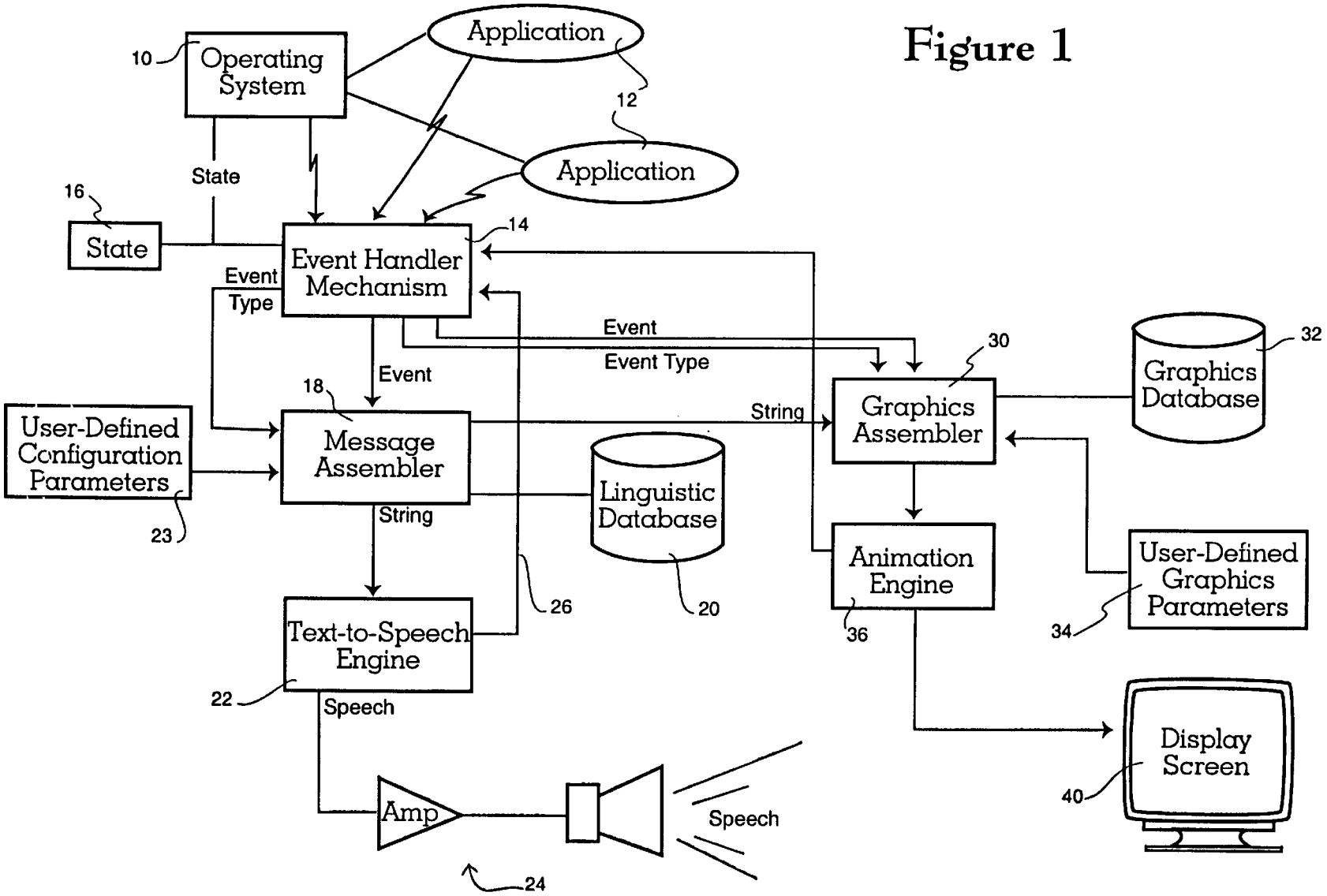

Referring to FIG. 1, the computer personality module (screen saver and message notification system) of the preferred embodiment is an event driven computer program that responds to events generated by either the operating system 10 or by one or more application programs 12 that are in turn controlled by operating system 10. In a simple screen saver application the event may be the passage of a predetermined time during which no user interaction is sensed. However, as will be more fully explained, the system is not limited to simple screen saver events; rather the system can provide messages to the user based on a wide variety of different events. Such events include the printer running out of paper, the occurrence of a predetermined date and time (holiday, anniversary, birthday), detection of computer virus signatures during file activity, disk full warning messages, and the like.

Events generated by the operating system or application programs are monitored by the event handler mechanism 14. The event handler mechanism may be configured to monitor the message queue of the operating system, to detect when predetermined events have occurred. In the preferred implementation the event handler maintains a data store 16 in which predetermined state variables may be stored for future reference. These state variables may store a record of previous activities performed by the screen saver and message notification system. These variables are useful in simulating more sophisticated computer-generated personalities, in which the message, voice, tone and other parameters may be changed dynamically as the system operates. Use of state variables permits, for example, the system to alert the user in a different fashion if previous alert messages have been ignored. For example, the tone of voice or pitch modulation may be changed to convey a heightened sense of urgency if an alert condition previously reported persists.

In addition to state variables maintained by the event handler in store 16, the event handler is also able to obtain operating system and application program state variables directly from the operating system by sending requests for this information through the operating system message queue.

The event handler mechanism 14 serves as the primary interface to the message assembler module 18. The message assembler selects words or phrases from a linguistic database 20 and concatenates these messages into text strings for delivery to the text-to-speech engine 22. The message assembler is capable of assembling a wide variety of different messages, based in part on user-defined configuration parameters 23 stored in parameters data structure, and also based in part on the type of event as signaled by the event handler mechanism 14. The message assembler will extract words and phrases from the linguistic database. These words and phrases may be tagged to indicate the linguistic context (or to signify the kind of mood the system is imitating). Such tags might include "formal," "informal," "old fashioned," and so forth. These words and phrases may also be appropriately tagged to notify the text-to-speech engine of which voicing parameters to use. Examples might include (male/female), (adult/child/old person), (human/alien/robot/animal). In this regard, the text-to-speech engine 22 may produce a synthesized output for playback through the computers amplification and speaker system 24. The preferred embodiment employs the Panasonic STL CyberTalk text-to-speech engine. Other suitable text-to-speech engines may also be used. Preferably the text-to-speech engine will provide different male and female voices, with different intonations, allowing the text-to-speech engine to produce natural sounding speech with pauses and inflections appropriate to the context.

The text-to-speech engine provides feedback via path 26 to the event handler mechanism 14, to notify the event handler when the text-to-speech engine is finished playing back a given message. In a Microsoft windows environment the feedback may be supplied through the Microsoft SAPI (Speech Application Platform Interface) protocol.

The event handler mechanism 14 also serves as the primary interface to the graphics assembler module 30. Graphics assembler module selects graphics images or animation sequences from a graphics database 32. Like the message assembler 18, the graphics assembler 30 accesses user-defined graphics parameters 34 that may be stored in a suitable computer memory. If desired, the user defined configuration parameters 23 and the user defined graphics parameters 34 may be linked together, allowing coordination between spoken messages and on-screen graphics. Also like the message assembler 18, graphics assembler 30 receives event messages from event handler 14, which may include event type information. Thus the graphics assembler is capable of assembling different graphical images, depending on the type of event detected by the event handler mechanism. The text string generated by the message assembler 18 may be supplied to the graphics assembler 30 to allow text to be displayed on the display screen 40.

The animation engine 36 displays the graphical images or animation sequence on the computer display screen 40. The animation engine may employ any suitable animation display technology such as QuickTime, Microsoft Media Player or the like.

In FIG. 1 separate data flow lines have been used to illustrate event messages and event type information flowing from the event handler 14 to the message assembler 18 and to the graphics assembler 30. This has been done to highlight the fact that the preferred embodiment responds differently to different types of events. In a software implementation the event message may suitably embed the event type information such that separate event and event type data flow paths would not be required.

Figure 2:
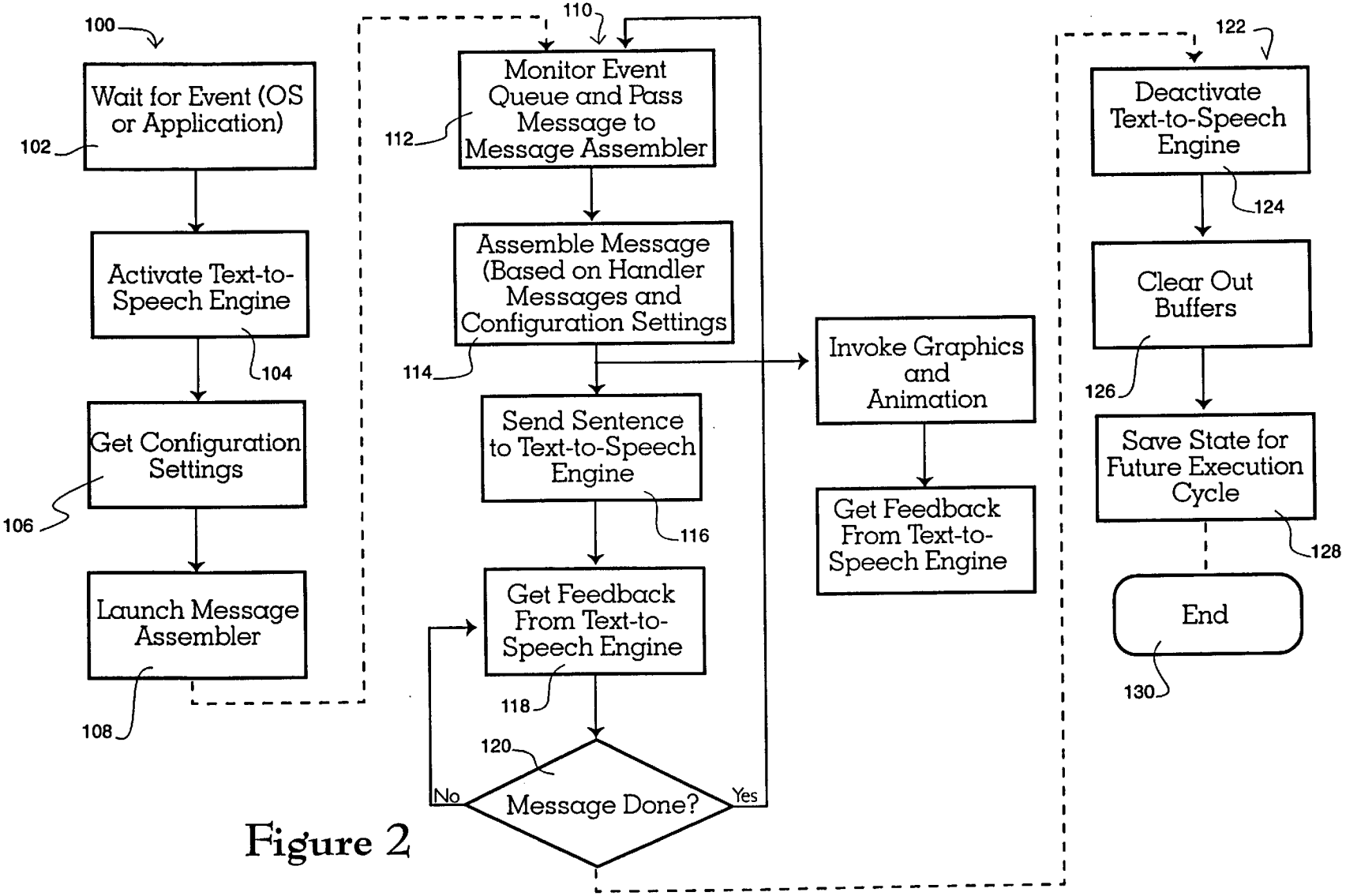

FIG. 2 shows the operation of the embodiment of FIG. 1. In FIG. 2 the operation involves three separate processes: startup process 100, main loop process 110 and shutdown process 122. These three primary processes run independently of one another although there is interaction as signified by the dashed lines in FIG. 2. The dashed lines illustrate that the startup process is run in preparation for executing the main loop process; and the shutdown process is run after the main loop process has terminated for any one of a variety of reasons.

The startup process begins at Step 102, where the process waits for an event. As illustrated in FIG. 1, the event can come from either the operating system 10 or from one or more application programs 12.

Upon detection of an event, Step 104 activates the text-to-speech engine. Activation of the engine includes loading pointers to the appropriate speech sound files. While the text-to-speech engine is being activated, Step 104 obtains the configuration settings from the user-defined configuration parameters 23 and the message assembler 18 is then launched at Step 108.

At this stage, the message assembler is ready to generate messages, although no messages have necessarily been assembled at this point.

The main loop 110 takes over after startup by monitoring the event queue at step 112. Events in the event queue are compared with a predetermined list of messages to which the event handler responds. When a message on the list is detected by the event handler 14, the event handler passes a message to the message assembler 18.

In Step 114 the message assembler 18 assembles a message based on the handler message sent in Step 112 and further based on the configuration settings identified in Step 106. In general, the message assembler at Step 114 accesses the user-defined configuration parameters 23, based on the event type, and then uses the selected parameters to access the linguistic database 20. Data from the linguistic database 20 is then concatenated to form the text string message that is sent to the text-to-speech engine in Step 116. Contatenation may include adding suitable symbols to indicate inflection, and to add appropriate endings to verbs to reflect present vs past tense and to indicate whether the subject is singular or plural.

The text-to-speech engine operates independently of the event handler mechanism in the preferred embodiment. Thus the event handler mechanism needs to be signaled when the text-to-speech engine has completed playback of the message. This is accomplished through feedback along path 26 (FIG. 1). Thus the message handler in Step 118 gets feedback from the text-to-speech engine, whereupon a test is performed at Step 120 to determine whether the message is done. If the message is not done control branches back to Step 118 where the text-to-speech engine continues to wait in the feedback monitoring loop. Once the message is done the main loop branches back to Step 112, where the main loop process can repeat.

Certain events will terminate the text-to-speech message playback system. For example, the system can be configured to terminate playback operations when the user resumes interaction with the computer through the keyboard, pointing device or speech recognizer interface. The system can also terminate in response to other events generated by the operating system or by application programs.

Upon termination the shutdown procedure 122 is performed. This procedure begins at Step 124 by deactivating the text-to-speech engine. Next all buffers used by the engine are cleared out at Step 125, returning the memory to the system heap for use by other applications. Finally, if desired, the system may save its state at Step 128 for future execution cycles. Saving state involves recording preselected parameter values in the state data store 16 (FIG. 1). After saving state the procedure terminates at Step 130.

The message notification system generates pseudo-random sentences using a simple finite state grammar. For event notification, a simple alert-subject-notification grammar is presently preferred. As explained below, more complex pseudo-random sentences are also possible using a more complex, tree-structured grammar.

The simple pseudo-random sentence generation mechanism for event notification produces novel messages randomly (although really from a theoretically finite set), but still manages to convey useful information.

For example, consider the case where the user needs to be informed that the printer is out of paper. The system might desirably generate sentences such as:

"Alert! The printer is out of paper!"

"Your data output device needs paper."

For added entertainment value, a user-defined parameter could establish politeness levels, so that messages would range from:

"Hey stupid! The laserjet ain't doing much 'til you put some paper in!"to

"If I may interrupt, the printer requires servicing."

The screen saver and message notification system selects which level of politeness is appropriate, based on previously stored or previously determined state variables. If desired, these state variables may also be used to code the text strings such that the text-to-speech engine will simulate rising exasperation (altering tone or inflection) if the situation is not attended to.

A simple notification system of the preceding type can be implemented by the following finite state grammar:

alert message→subject id→notification

The linguistic database contains a lexicon of possible words or phrases to fill each of these finite state slots in the grammar. To illustrate, consider the following example:

alert message: "Pardon,", "Warning!", "Yo!", "Excuse me,", (empty), . . .

subject id: "the printer", "your printing device", "that thing that your documents come out of", "the !@#@! printer", etc.

notification: "is out of paper", "requires service", "is feeling an absence of wood-pulp products", etc.

Items to fill the slots in the grammar would be chosen pseudo-randomly; the choice may be random, but items in the lexicon may be tagged with features like "formal", "rude", "funny", etc., and depending on the user-defined configuration parameters or other state variables, items with certain tags may be preferred or excluded.

For more complex sentence generation, a three pass generation process may be employed. The three pass process generates a nearly unlimited variety of sentences which don't necessarily have to mean anything. The three pass process proceeds according to the following computer-implemented steps:

1. Build a tree structure, whose branches are words and phrases.

2. Put the elements in order: at each branch, identify what order the daughter nodes come in.

3. Select text corresponding to each node, working from branches upwards by concatenation. (And adding inflections where appropriate).

In more detail, each of the three pass steps is performed as follows:

Tree Building:

1. Generate a data structure for a clause.

2. Assign the clause a verb, selected randomly from the lexicon. The choice of the verb may be affected by user-defined parameters, and by event types. (Verbs may be tagged as appropriate for certain situations).

3. Each verb in the lexicon is listed with argument types (i.e, subjects, objects, dependent clauses), and the clause is now assigned subjects and objects, as are appropriate.

4. Subjects and objects in the clause are filled with randomly selected noun-phrase elements from the lexicon.

These choices may also be effected by parameters or event types, and noun phrases can also be tagged as appropriate for certain situations.

5. If one or more arguments is a subordinate clause, return to above step 1 and repeat this process for it/them.

(To ensure that the sentence does not become too complex, in above step 2, a mechanisms can be implemented which rejects verbs taking subordinate clauses after a certain depth of clause embedding).

Putting elements in order:

1. In each clause, simple rules (such as subjects come before verbs, which come before objects) are applied to determine what order to put its elements.

2. Since subordinate clauses will be ordered with respect to other elements of their mothers, if this process will specify an ordering for every element in the sentence.

Selecting text for each node:

1. For noun phrases, the text is determined just by looking up what is listed in the lexicon—currently no alternations are made.

2. For verbs, it is necessary to add inflections for subject agreement, tense, etc. Note that auxiliaries like "will", "might", etc. are treated as verb inflections (although separated by white space from the verb) rather than as separate words.

Although the above three pass process will generate a wide variety of different sentences, customization is possible in several areas. By way of example and not limitation, consider the following areas of customization.

Customization:

First, lexical items can be tagged as appropriate for certain situations, and the choice can be weighted to favor or disfavor words with certain tags in different states, as in the simple version outlined above. Other possible customizations include possible parameter settings for the ordering and inflection modules. In our current system, it is possible to turn on an "archaic mode" switch which will cause the regular -s ending of third-person-singular present tense verbs to be replaced with the archaic "-th", so that "walks" becomes "walketh", etc. It might also be possible to configure the word order module; for example, a "poetic license" switch might be turned on. Or perhaps, with a text-to-speech engine able to imitate foreign accents, the sentence generator might be made to imitate the kinds of grammatical errors various nationalities of non-native English speakers are known to make.

If desired, the system will accommodate user-loadable linguistic databases that may supplement or replace the standard linguistic database. The user-loadable components might be tied to different professions or family applications for more interesting random sentence generation. For example, user-loadable dictionary components may be geared for such as users as "children, lawyers, doctors, engineers, in-laws". The personality module/screen saver for children might thus include words familiar to children, like:

| | |
|---|---|
| tree | eat |
| monkey | ice cream |
| finger | bubble |
| grandma | run |
| grandpa | fast |
| summer | walk |
| ocean | swim |
| mom | clean |

-continued

| | |
|---|---|
| dad | stop |
| me | no |
| you | cool |
| nap | |

Graphics Generation:

The screen saver and message notification system can implement a wide variety of different entertaining and useful graphical displays, ranging from simple on-screen text display to integrated full motion video and/or animation.

A simple screen saver application may be constructed according to the invention, whereby the user can program the system to display on-screen the random sentences as constructed by the message assembler. The text may float randomly on the screen as the text-to-speech engine is speaking. The graphics assembler receives String data from the message assembler and these data are used to generate printed text that is displayed at a randomly moving starting point. The animation engine may, if desired, display the text in a randomly moving or other predetermined geometric or random pattern. The user can select the font type/size and text color for the displayed text. These user-defined selections may be stored as part of the user-defined graphics parameters. Floating text can be combined with randomly created patterns behind it.

Using word or content associations, various characters may be drawn/animated by the animation engine. For example, if the user wants to show the sentence on the screen saver "Giraffes singing Xmas Carol", the graphics assembler might allow the user to use the word "Giraffe" as a base picture with the subject Xmas, causing things like scarf/coat/snowflake being generated on and around the giraffe. This would be done by noting various image element reference points where logged within each base picture, so all additions/changes will fit properly within the screen display.

The system permits user freedom in choosing pictures for animation. For instance, the system can provide a set of scarves/coats or various type of snowflake for the user to select. The user can ornament each graphics object entered into the scene, as if dressing up a paper doll on the screen saver. This would be done before the screen saver is started or in some cases during screensaver operation. Screensaver operation can be configured such that it supports a lockout feature, to prevent unwanted access to PC. In this mode of operation, keyboard/mouse activity is trapped and directed to the screen for use in modifying graphical scenes until an unlock key sequence is entered.

The preferred embodiment allows multiple levels of user involvement, ranging generally from minimal user involvement to full user involvement. Three levels of user involvement will be described here. When minimal user involvement is selected, the system provides everything automatically, so that the user simply installs the computer personality module on his or her system and then allows it to operate. The user is provided with a simple user interface for choosing fonts/colors for graphics or choosing voice type for synthesis, but the system will supply default settings if the user makes no selections. A suitable user interface may be constructed using standard configuration control panels provided by the operating system.

When intermediate user involvement is selected, the user may select additional parameters through the user interface. These parameters might include degree of politeness. The system automatically determines the tone of voice appropriate to current context and to the sentence being spoken.

When maximal user involvement is selected, the user may specify essentially all parameters used by the system. This is done by allowing the user to putting tags after words in a text string sentence. Some tags have local effect; other tags have global effect. To illustrate, parameters 6 and 7 in the following set have local effect, whereas parameters 1–5 have global effect.

Text String Tags:

1. Speaker type: human, alien, robot, animal
2. gender: male, female, unisex
3. age: baby, toddler, child, teenager, adult (middle-aged, really old)
4. language: English (with or without accent, e.g. foreign, local dialect variations), Old English, Japanese, Chinese, French, Italian, German, etc.
5. voice type: normal, husky, cute, nerdy, smoker, etc.
6. emotion: happy, sad, indifferent, funny, angry, grouchy, etc.
7. degree of politeness: super-polite, polite, normal, casual, rude Tags may be placed in-line within the sentence or phrase to be spoken. In the following example, the tags are shown in parentheses. The text-to-speech engine selects the appropriate voice or tone according to the tags as they are encountered while processing the text string.

Example of Text String with Tags:

"I will be back by 20th (politeness:normal). I said "Be Back by the day after tomorrow" (grouchy). Ha, ha! I will be on a fun trip!!! (happy) See you soon. (happy)"

These tags modify the acoustic parameters and send the appropriate ones to the text-to-speech engine.

Conclusion

From the foregoing it will be appreciated that the present system provides a computer personality module (screen saver and message notification system) that has the potential to greatly enhance the experience of using a computer system. While the invention has been described in its presently preferred form, it will be understood that the invention is capable of certain modification without departing from the spirit of the invention as set forth in the appended claims.

We claim:

1. A computer personality module for providing pseudo-randomly varied speech messages in response to predetermined conditions in the computer operating system or in an application program, comprising:

an event handler responsive to at least one of said operating system and application program for generating event notification messages in response to predetermined conditions;

a message assembler receptive of said event notification messages for assembling text strings corresponding to said event notification messages; and text-to-speech engine receptive of said text strings for generating speech messages corresponding to said text strings;

wherein said message assembler employs a finite state grammar that defines finite state slots for insertion of words to construct the event notification message, and wherein said message assembler further employs a pseudo-random word generator for pseudo-randomly selecting and placing words in said finite state slots to thereby vary the text of the event notification message for a given predetermined condition.

2. The personality module of claim 1 wherein said event handler includes data structure for storing state variables used by said event handler in generating said event notification messages.

3. The personality module of claim 2 wherein said event handler stores state variables associated with at least one first event notification message, and wherein said event handler reads said stored state variables in generating at least one second event notification message subsequent to said first event notification message.

4. The personality module of claim 2 wherein said event handler stores state variables associated with predetermined conditions in at least one of said computer operating system and said application program, and wherein said event handler reads said stored state variables in generating at least one event notification message.

5. The personality module of claim 1 wherein said event handler accesses at least one of said computer operating system and said application program to determine state variables associated with predetermined conditions in at least one of said computer operating system and said application program, and wherein said event handler uses said state variables in generating at least one event notification message.

6. The personality module of claim 1 wherein said message assembler includes linguistic database containing predetermined lexicon of words that said message assembler uses in assembling said text strings.

7. The personality module of claim 1 wherein said event handler categorizes event notification messages by event type and wherein said message assembler assembles text strings based at least in part on said event type.

8. The personality module of claim 1 wherein said message assembler includes data store of user-defined configuration parameters and wherein said message assembler assembles text strings based at least in part on said user-defined configuration parameters.

commands and uses said dialog context to select among said plurality of word candidates.

9. The personality module of claim 1 further comprising graphics module responsive to said event notification messages for generating graphical images upon a display screen corresponding to said event notification messages.

10. The personality module of claim 1 further comprising graphics assembler responsive to said event notification messages for assembling graphical image data corresponding to said event notification messages.

11. The personality module of claim 10 further comprising animation engine receptive of said graphical image data for generating animated graphical image sequences corresponding to said graphical image data.

12. The personality module of claim 10 wherein said graphics assembler includes graphics database containing predetermined graphical images that said graphics assembler selects in assembling said graphical image data.

13. The personality module of claim 10 wherein said graphics assembler includes data store of graphics parameters and wherein said graphics assembler assembles graphical image data based at least in part on said graphics parameters.

14. The personality module of claim 13 wherein said graphics parameters are user definable.

* * * * *